US008069504B1

(12) United States Patent
Greenfield, Jr.

(10) Patent No.: US 8,069,504 B1
(45) Date of Patent: Dec. 6, 2011

(54) BLADDER FOR WINTERIZING A SWIMMING POOL

(76) Inventor: William C. Greenfield, Jr., Martinsburg, WV (US)

( * ) Notice: Subject to any disclaimer, the term of this patent is extended or adjusted under 35 U.S.C. 154(b) by 232 days.

(21) Appl. No.: 12/387,298

(22) Filed: Apr. 30, 2009

Related U.S. Application Data

(60) Provisional application No. 61/125,872, filed on Apr. 30, 2008.

(51) Int. Cl.
*E04H 4/00* (2006.01)

(52) U.S. Cl. ..... 4/499; 4/503

(58) Field of Classification Search ..... 4/499, 498, 4/503

See application file for complete search history.

(56) References Cited

U.S. PATENT DOCUMENTS 3,063,062 A * 11/1962 Logan ..... 4/499
3,453,666 A 7/1969 Hedges
3,528,110 A * 9/1970 Woycik ..... 4/503
3,676,880 A 7/1972 Kwake
3,683,427 A 8/1972 Burkholz et al.
3,918,221 A * 11/1975 Benjamin ..... 52/1
4,048,678 A 9/1977 Chillino
4,122,561 A 10/1978 Barr
4,601,072 A 7/1986 Aine
4,665,935 A * 5/1987 Nichols ..... 135/125
4,825,479 A 5/1989 Bonneau
5,144,704 A * 9/1992 Genzel et al. ..... 4/499
5,293,652 A 3/1994 Furr
5,860,413 A 1/1999 Bussey, Jr. et al.
6,296,459 B1 * 10/2001 Saputo et al. ..... 417/423.14

* cited by examiner

*Primary Examiner* — Gregory Huson
*Assistant Examiner* — Janie Christiansen

(57) ABSTRACT

An inflatable domed pool bladder for use when winterizing swimming pools is herein disclosed, comprising a large inflatable bladder which covers the entire pool surface wherein a center of the dome is higher than the sides. In this manner when a conventional pool cover is installed over the bladder, it is kept above the level of the side walls of the swimming pool and any rain, snow, leaves or other debris are unable to accumulate. The bladder prevents water from pooling on the cover, reducing the risk of drowning by young children or pets. Also, a potential cost savings results from improved water retention efficiency within the swimming pool.

17 Claims, 4 Drawing Sheets

BLADDER FOR WINTERIZING A SWIMMING POOL

RELATED APPLICATIONS

The present invention was first described in and claims the benefit of U.S. Provisional Application No. 61/125,872, filed Apr. 30, 2008, the entire disclosures of which are incorporated herein by reference.

FIELD OF THE INVENTION

The present invention relates generally to accessories for swimming pools, and more particularly, to an inflatable bladder for use in winterizing swimming pools.

BACKGROUND OF THE INVENTION

Swimming pools have become increasingly popular and mainstream as the cost associated with installing and maintaining pools has decreased. With that increasing popularity the biggest decision becomes whether to choose an above ground or below ground pool. Many people prefer in-ground pools, but the ease to installation and maintain, increased safety, and lower costs of above ground pools often seems like a better choice. Since they are above ground level, the majority of surface debris cannot find its way into the pool making above ground pools easier to keep clean. Although above ground pools are susceptible to falling debris and still require covering during the non-pool seasons.

Above ground pool owners who live in areas that require that they leave them covered during the winter months know all too well of the burdens and hassles associated with pool cover maintenance. Several attempts have been made in the past to provide a means of covering a pool including several U.S. patents, including; U.S. Pat. No. 3,453,666, issued in the name of Hedges, which describes a solar thermal blanket; U.S. Pat. No. 3,683,427, issued in the name of Burkholz et al., which describes an outdoor swimming pool with dome; U.S. Pat. No. 4,122,561, issued in the name of Barr, which describes a floating cover capable of partially or fully covering swimming pools; and U.S. Pat. No. 5,293,652, issued in the name of Furr, which describes a swimming pool winterizing method and apparatus. U.S. Pat. No. 4,601,072, issued in the name of Aine, describes a swimming pool cover comprising an insulated buoyant cover for a pool having an inflatable bladder that rests on the water surface and tethered weights to retain the cover in a fully covered position. U.S. Pat. No. 5,860,413, issued in the name of Bussey, Jr. et al., describes a pool cover comprising a multi-layer construction that rests on the water surface of the pool and a roller for deployment and retraction of the cover.

Typically, these covers are anchored around the pool perimeter and supported in the pool surface itself or on balloon like floats. The floating supports tend to either deflate or move about resulting in sagging portions that collect leaves, water, and other debris. As a result, the pool owner must regularly adjust the cover, re-position and inflate the floats, and tighten the perimeter anchoring. The cover can also become damaged and torn due to stress created by the collected water and debris. The cover may then need to be replaced prematurely and at a considerable additional cost. Finally, such pockets of trapped water pose a drowning hazard to children or pets. One (1) solution to these problems has been to provide an arched or dome shaped cover for swimming pools. These solutions suffer from various disadvantages including; requiring a constant projection of air to maintain a domed structure, utilizing a framework structure that has to be assembled and disassembled each season, or combining an inflation means to the pool cover that can require replacement of the entire assembly if the cover is damaged.

U.S. Pat. No. 4,048,678, issued in the name of Chillino, describes an inflatable cover for a swimming pool comprising a solid material that extends over the entire pool in a dome-like configuration, a skirt which engages the inner walls of the pool, and extended end portions that rest on the deck of the pool and receive water bags to hold the cover in place.

U.S. Pat. No. 3,676,880, issued in the name of Kwake, describes an inflatable enclosure for swimming pools and the like comprising an enclosure for swimming pools that can be inflated by a blowing means to a domed position. When the enclosure is inflated a non-zipper entry allows a person to enter the enclosure which acts a crowned cover to shield rain or dirt.

U.S. Pat. No. 4,825,479, issued in the name of Bonneau, describes an inflatable swimming pool cover comprising a sheet cover adapted to become arched when air pressure is projected under the cover via an air blower.

While these devices fulfill their respective, particular objectives, each of these references suffers from one (1) or more of the aforementioned disadvantages. Accordingly, the need has developed for a pool covering method that solves the problems associated with conventional methods. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to prevent the build-up of debris on top surfaces of pool covers and thus, the object of the present invention is to solve the aforementioned disadvantages.

To achieve the above objectives, it is an object of the present invention to provide an inflatable bladder for winterizing swimming pools that provides an inflatable domed bladder, shaped such that the center of the dome is higher than the perimeter sides, for use with a swimming pool and pool cover. A conventional pool cover can be installed over the bladder and is kept above the level of the side walls of the pool by the inflated bladder. The domed shape of the bladder provides a means to prevent any rain, snow, leaves or other debris from collecting on top of the pool cover as is normally seen.

Another object of the inflatable bladder is to provide a device comprising a large inflatable bladder which covers the entire pool surface, a plurality of tie-down loops that provides a means of retaining the device to the ground, at least one (1) air intake valve that provides a means to receive air from an air pump assembly, and at least one (1) valve seal cap that allows access to and covers the intake valve and sealing of an internal air chamber.

Yet still another object of the inflatable bladder is to provide an inflatable bladder that provides a dome-shaped structure comprising a cylindrical outer wall, at least one (1) dividing inner wall, a floor portion, and a dome portion. The inner walls are attached to the adjacent outer walls, the floor portion, and the dome portion forming at least one (1) isolated inflatable air chamber. The inflatable bladder provides a shaping means to maintain a constant overall dome-shape as well as isolating deflation of the inflatable air chambers in an event of a leak or puncture to a single chamber.

Yet still another object of the inflatable bladder is to provide an air pump assembly that provides a portable detachable means to inflate the inflatable bladder utilizing an available electrical outlet. The air pump assembly comprises an air compressor, an air inlet nozzle, an air outlet nozzle, a power switch, a power cord, an air hose, and a bladder fill nozzle. The air outlet nozzle and bladder fill nozzle comprise common barbed fittings providing a snug interference fit into the respective air hose and bladder air valve and fast convenient assembly and disassembly of the air hose during an inflating process.

Yet still another object of the inflatable bladder is to provide a method of utilizing the device which not only allows pool owners to keep rain, snow, leaves, and other debris off of their pool cover over the winter months, but makes it safer for children and pets as well.

Further objects and advantages of the inflatable bladder will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
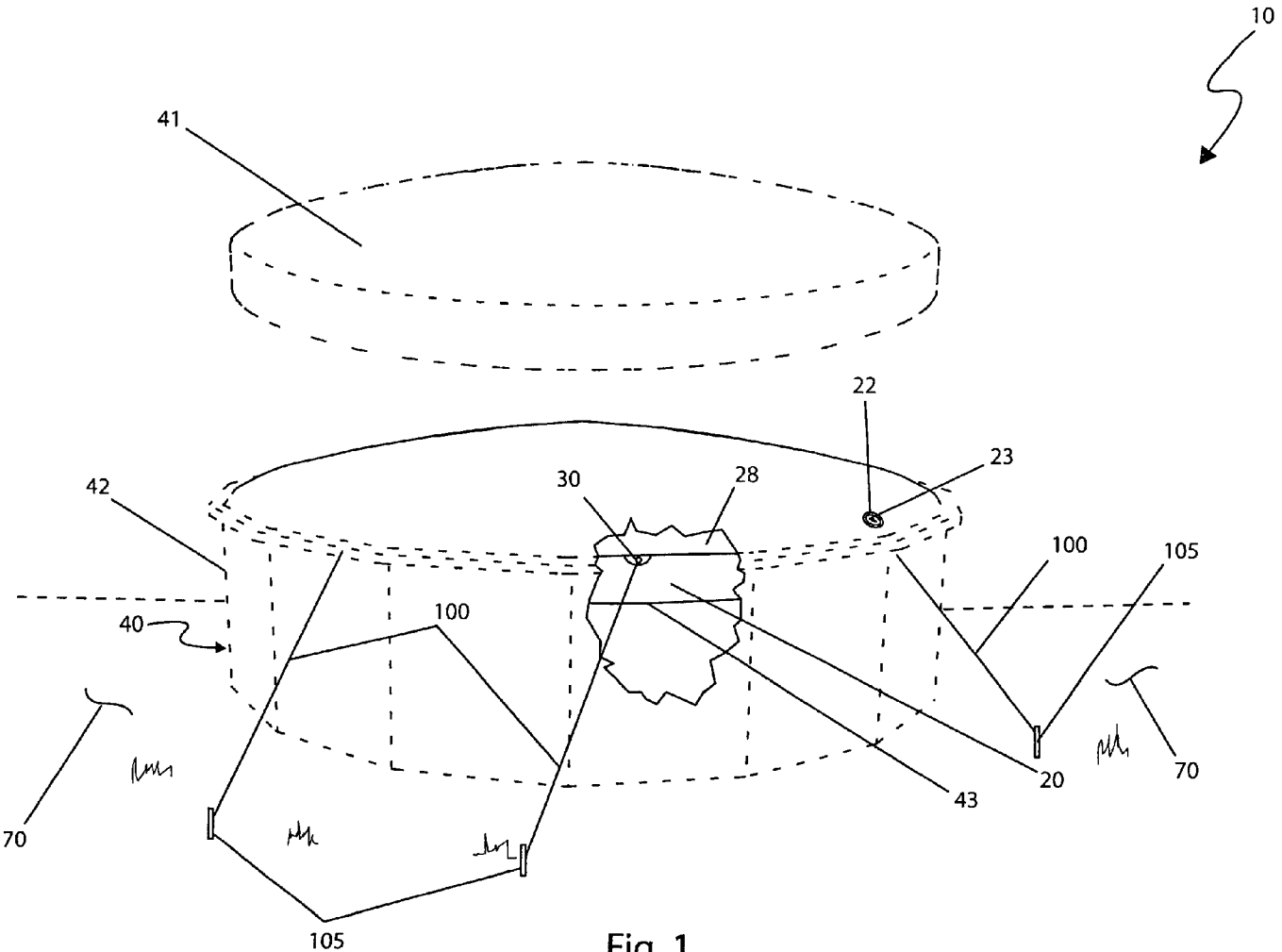
FIG. 1 is an environmental view of the bladder for winterizing swimming pools 10 showing a pool water level 43, according to a preferred embodiment of the present invention.

| | |
|---|---|
| 10 | bladder for winterizing swimming pools |
| 20 | inflatable bladder |
| 21 | air chamber |
| 22 | air valve |
| 23 | air valve seal cap |
| 24 | outer wall |
| 25 | inner wall |
| 27 | floor portion |
| 28 | dome portion |
| 30 | tie-down loop |
| 32 | eyelet |
| 40 | pool |
| 41 | pool cover |
| 42 | pool wall |
| 43 | water level |
| 50 | air pump assembly |
| 52 | compressor |
| 54 | air inlet nozzle |
| 56 | air outlet nozzle |
| 58 | power switch |
| 60 | power cord |
| 62 | air hose |
| 64 | bladder fill nozzle |
| 70 | grade surface |
| 100 | tie-down |
| 105 | anchoring stake |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an inflatable bladder for winterizing swimming pools (herein described as the "device") 10, which provides an inflatable domed bladder for use when winterizing a pool 40. The device 10 comprises a large inflatable bladder 20 which covers the entire pool surface 40. Additionally, the bladder 20 is shaped such that the center of the dome is higher than the sides. In this manner when a conventional pool cover 41 is installed over the bladder 20, it is kept above the level of the side walls 42 of the pool 40, thereby diverting any rain, snow, leaves or other debris therefrom the pool 40. By eliminating the presence of water on the pool cover 41, the risk of young children or pets drowning by reduced. It is also understood that the device 10 provides improved water retention within a pool 40 during an offseason, thereby resulting in a potential cost savings.

Referring now to FIG. 1, an environmental view of the device 10 showing a pool water level 43, according to the preferred embodiment of the present invention, is disclosed. The device 10 comprises a plurality of tie-downs 100 and anchoring stakes 105. During winterizing, the water level 43 in the pool 40 is lowered slightly and the device 10 is envisioned to float on the surface of the water 43 such that the outer edge of the domed portion 28 of the device 10 is approximately equal to or slightly above the top of the pool wall 42. A conventional pool cover 41 can then be placed over the device 10 and the pool 40, and attached in a conventional manner, thereby retaining the device 10. The device 10 provides a raised domed shape thereto the pool cover 41 when the inflatable bladder 20 is inflated using an air pump assembly 50 (see FIG. 3), thereby providing a means to prevent water, leaves, or other debris from collecting on top of the pool cover 41.

The tie-downs 100 comprise common commercially available rubber or cloth/rubber cords having hooked end portions being affixed thereto said tie-down loops 30 and extending thereto a grade surface 70. Said tie-downs 100 are then attached thereto a grade surface 70 using common metal or wooden anchoring stakes 105 or equivalent anchoring means. The tie-down loops 30 and corresponding tie-downs 100 provide extra positional stability thereto the device 10 as well as keeping the pool cover 41 therein a taut state. The tie-downs 100 are especially useful where wind conditions are of a threatening nature. The tie-down loops 30 comprise semi-circular triangular-shaped sewn-in appendages made using similar materials as the inflatable bladder 20. The tie-down loops 30 also comprise corrosion-resistant crimped eyelets 32, thereby providing easy attachment of the aforementioned tie-downs 100.

Figure 2:
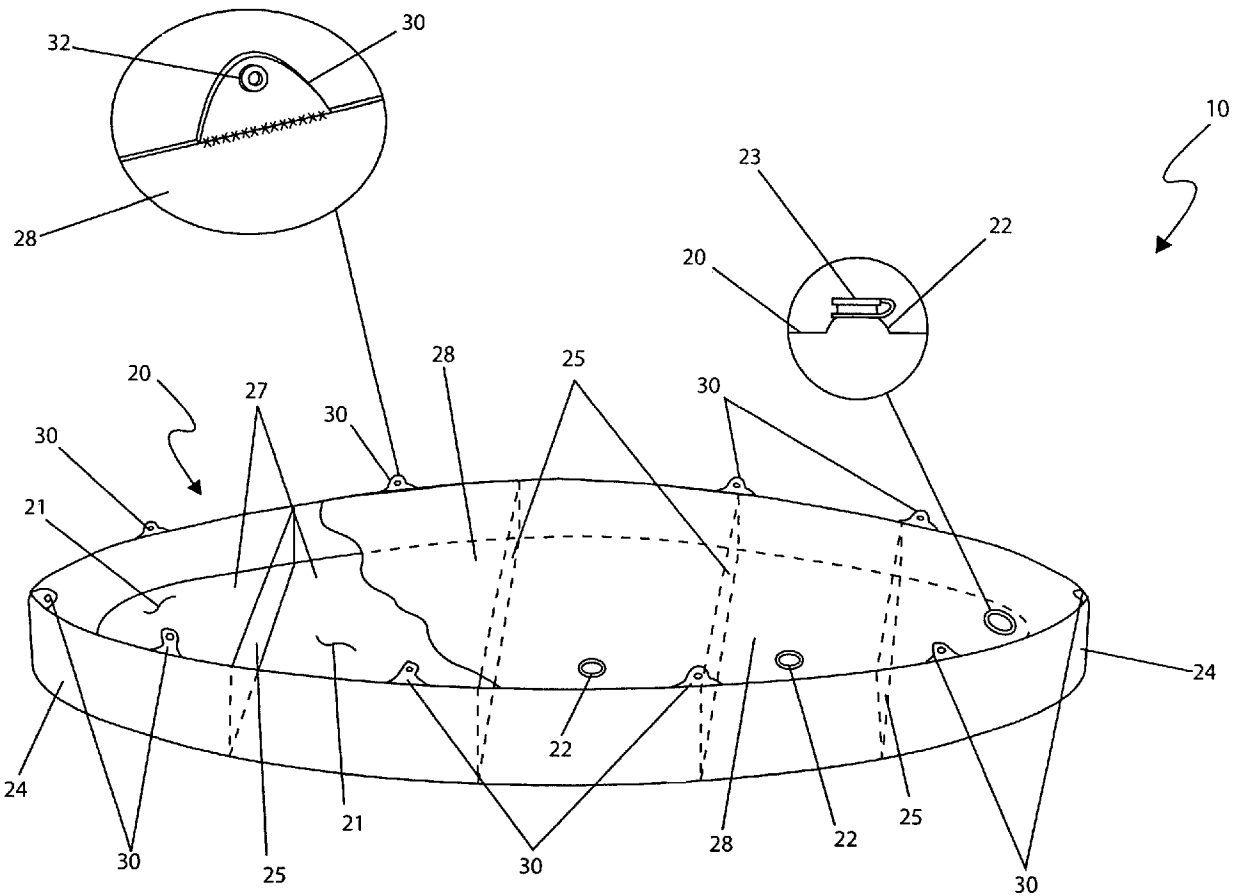
FIG. 2 is a side perspective view of a bladder for winterizing swimming pools 10, according to a preferred embodiment of the present invention.

Referring now to FIG. 2, a side perspective view of the device 10, according to the preferred embodiment of the present invention, is disclosed. The device 10 comprises an inflatable bladder 20, a plurality of air chambers 21, a plurality of air valves 22, and a plurality of tie-down loops 30.

The device 10 is illustrated here in a circular embodiment; however, the device 10 is understood to be provided in a variety of sizes and shapes which correspond thereto various perimeter designs of different size pools. The device 10 may be introduced in various popular pool shapes such as, but not limited to: round, oval, rectangular, and the like, and as such should not be interpreted as a limiting factor of the device 10. The inflatable bladder 20 comprises one (1) or more large internal air chambers 21 each with respective air valves 22, thereby providing an inflating means through which each air chamber 21 can be inflated or deflated using an air pump assembly 50 (see FIG. 3). The inflatable bladder 20 is depicted here having five (5) internal air chambers 21 arranged in a parallel manner; however, it is understood that any number and arrangement of air chambers 21 may be provided based upon a particular size or shape of the inflatable bladder 20, or may be based upon a user's preference. Each air chamber 21 comprises an air valve 22 further comprising a tethered air valve seal cap 23. The air valve 22 and air valve seal cap 23 are envisioned to be made using a durable sealing plastic material such as polyethylene, polyurethane, or the like. Each air valve seal cap 23 is removably attached in a tethering manner to maintain a sealing means thereto contained pressurized air. Said air valve seal cap 23 is permanently tethered thereto a side portion of the air valve 22 such that when the air valve seal cap 23 is removed to open the air valve 22, the air valve seal cap 23 will remain attached.

The inflatable bladder 20 provides a dome-shaped structure comprising a cylindrical outer wall 24, one (1) or more dividing inner walls 25, a floor portion 27, and a dome portion 28. Said inner walls 25 comprise a sewn and sealed attachment thereto adjacent outer walls 24, floor portion 27, and dome portion 28, thereby forming a plurality of isolated air chambers 21. The inner walls 25 provide a shaping means to maintain a constant overall dome-shape of the inflatable bladder 20 as well as isolating deflation of the inflatable bladder 20 in an event of a leak or puncture thereof. Said inner walls 25 are preferably arranged in a parallel manner thereto each other; however, it is understood that various numbers and arrangements of said inner walls 25 may be provided such as various rectangular matrices, radially extending sections, or the like, while providing equal function and benefit, and as such should not be interpreted as a limiting factor of the device 10. The individual elements of the inflatable bladder 20 are envisioned to be made using durable water-proof materials such as, but not limited to: rubber, polypropylene, puncture resistant polyvinyl chloride (PVC), UV coated vinyl, sealed canvas, or the like.

The upper outer seam formed by the outer wall 24 and dome portion 28 provide an attachment means thereto a plurality of tie-down loops 30 using common joining processes such as sewing, plastic welding, adhesives, or the like. The tie-down loops 30 are arranged in an equidistant manner along said upper peripheral edge region of the outer wall 24, thereby providing a means to anchor the device 10 thereto a grade surface 70 using common tie-down straps 100 or similar supporting means (see FIG. 1).

Figure 3:
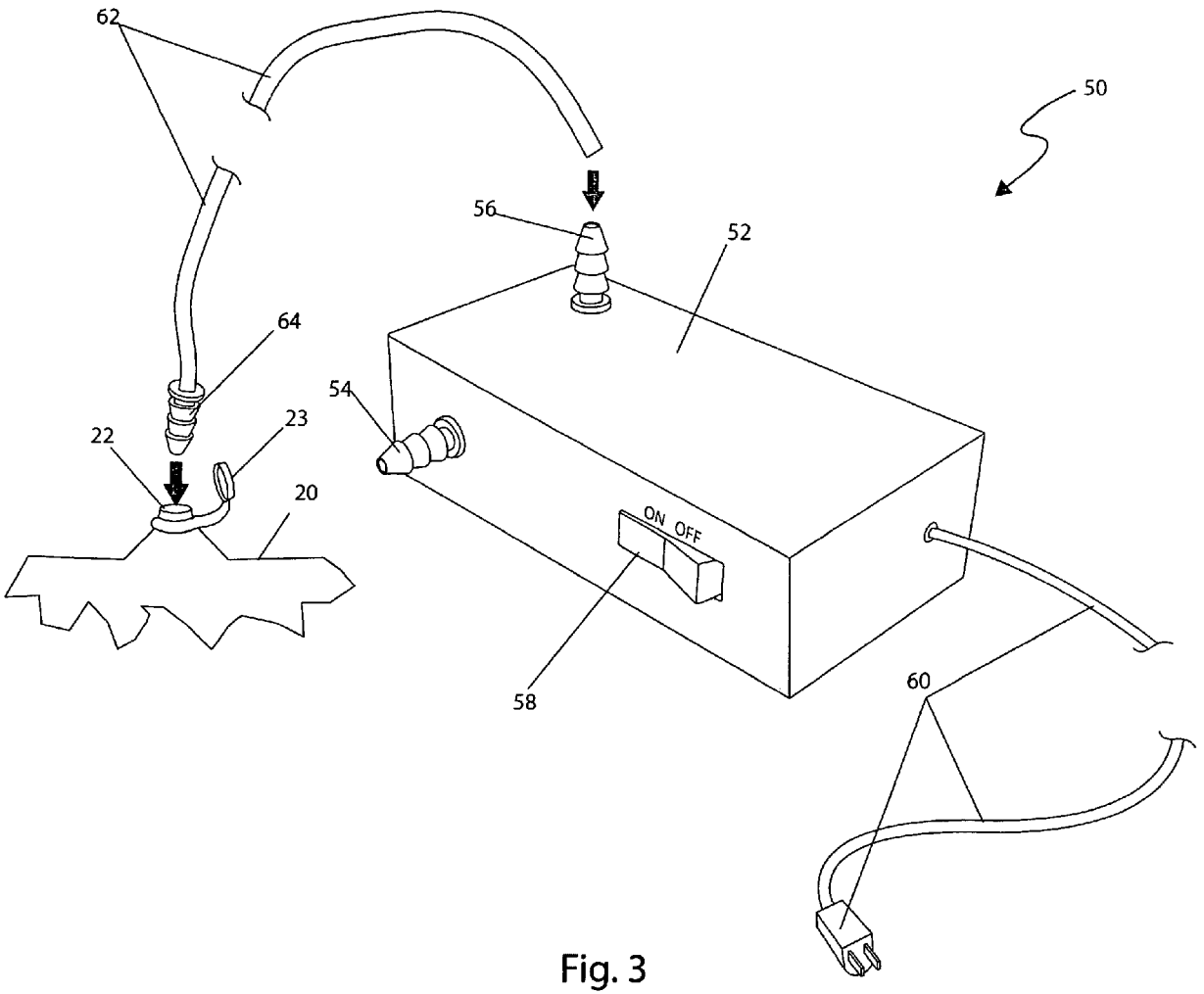
FIG. 3 is a close-up perspective view of an air pump portion 50 of the bladder for winterizing swimming pools 10, according to a preferred embodiment of the present invention; and, FIG. 4 is an electrical block diagram of the bladder for winterizing swimming pools 10, according to a preferred embodiment of the present invention.

Referring now to FIG. 3, a close-up perspective view of an air pump assembly portion 50 of the device 10, according to a preferred embodiment of the present invention, is disclosed. The air pump assembly 50 provides a portable detachable means to inflate the inflatable bladder 20 utilizing an available 110-volt outlet. The air pump assembly 50 comprises an air compressor 52, an air inlet nozzle 54, an air outlet nozzle 56, a power switch 58, a power cord 60, an air hose 62, and a bladder fill nozzle 64. The air compressor 52 comprises a compact 110-volt low-pressure unit envisioned to function in a similar manner as like compressors used to inflate air mattresses. The air outlet nozzle 56 and bladder fill nozzle 64 comprise common barbed fittings having particular diameters so as to provide a snug interference fit thereinto the respective air hose 62 and bladder air valve 22, thereby providing fast convenient assembly and disassembly of the air hose 62 during an inflating process. The air compressor 52 further comprises a standard power cord 60 and a toggle-type power switch 58 located along side surfaces to energize the air pump assembly 50 in an expected manner.

Figure 4:
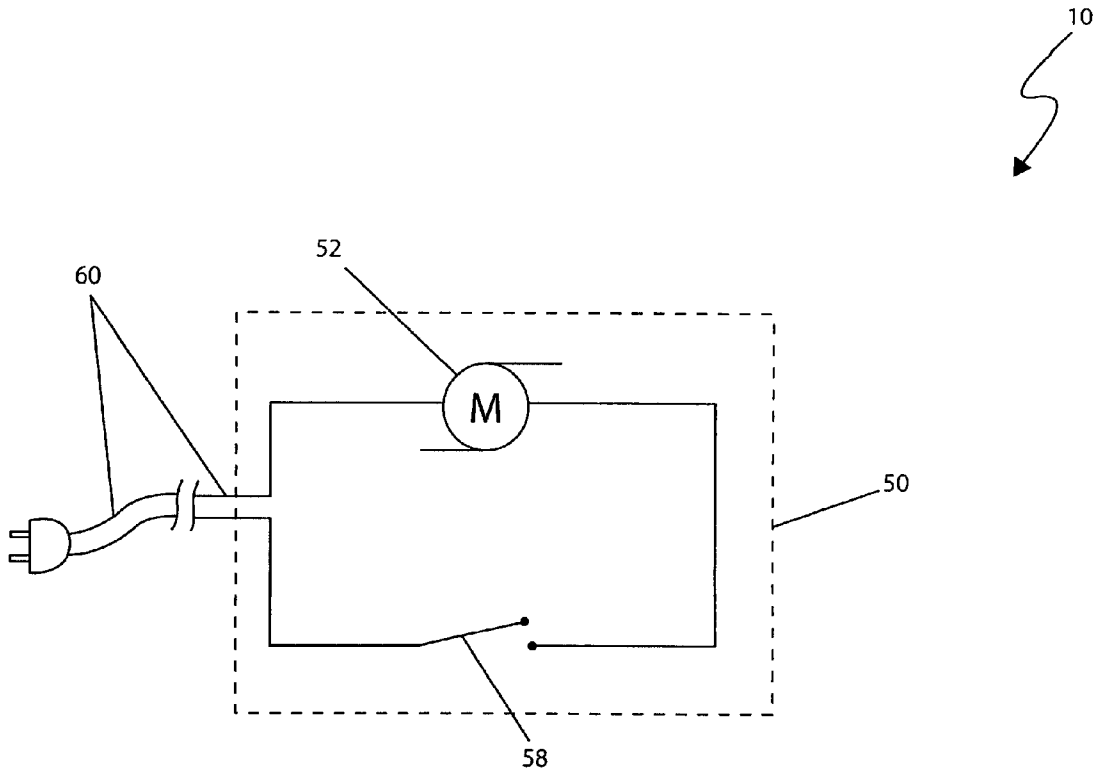

Referring now to FIG. 4, an electrical block diagram of the device 10, according to the preferred embodiment of the present invention, is disclosed. The device 10 comprises a 110-volt electric air compressor 52 having a standard 110-volt power cord 60 which is in electrical communication with the power switch 58. The power switch 58 is envisioned to be a single pole single throw toggle switch and is in electrical communication with the motor portion of the air compressor 52 such that it controls whether said air compressor 52 is "ON" or "OFF". The air compressor 52, the power switch 58, and the power cord 60 are envisioned to be standard commercially available items. The air compressor 52 is to be capable of quickly inflating or deflating the inflatable bladder 20.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: draining a volume of water therefrom the pool 40 thereby lowering the pool water level 43 to provide room for the inflatable bladder 20 and to correctly position said inflatable bladder 20 vertically; unfolding the inflatable bladder 20; laying the inflatable bladder 20 on the surface of the water in the pool 40 such that the air valves 22 are positioned slightly above the pool wall 42; anchoring the inflatable bladder 20, if desired, thereto a grade surface 70 using the tie-down loops 30, corresponding tie-downs 100, and anchoring stakes 105; connecting the air pump power cord 60 of the air pump assembly 50 thereto a suitable 110-volt power outlet; opening a single air valve 22 by removing the air valve seal cap 23 therefrom an end portion of said air valve 22; inserting the bladder fill nozzle 64 thereinto the air valve 22 until obtaining a secure fit; inserting the air outlet nozzle 56 of the compressor 52 thereinto the air hose 62, if not previously inserted; pressing the power switch 58 thereto the "ON" position to activate the air compressor 52; allowing a period of time to inflate the air chamber 21; turning off the power switch 58 on the air compressor 52 when the air chamber 21 is sufficiently pressurized; removing the bladder fill nozzle 64 therefrom the air valve 22; replacing the air valve seal cap 23 onto the air valve 22; repeating the inflating process for each air chamber 21 until the inflatable bladder 20 is completely inflated; pressing the power switch 58 thereto the "OFF" position; removing the bladder fill nozzle 64 therefrom the air valve 22; removing the power cord 60 therefrom the power source; repositioning, tensioning, or adjusting the inflatable bladder 20 as desired, using the tie-down loops 30 and corresponding tie-downs 100; placing the pool cover 41 on the pool 40 in a normal manner; and, storing the air pump assembly 50 in a suitable storage area until once again needed.

The method of un-installing and storing the device 10 may be achieved by performing the following steps: removing the pool cover 41 in the conventional manner; opening one (1) or more air valve seal caps 23 to start releasing the air within the air chambers 21; connecting the power cord 60 of the air pump assembly 50 thereto a power source; connecting the air hose 62 thereto the air inlet nozzle portion 54 of the compressor 52; attaching the bladder fill nozzle 64 thereto an air valve 22; pressing the power switch 58 to the "ON" position, thereby evacuating the air from the air chamber 21; removing the bladder fill nozzle 64 therefrom the air valve 22 once the air chamber 21 is completely evacuated; replacing the air valve seal cap 23; repeating the air removal process for each air chamber 21 until the entire inflatable bladder 20 is evacuated; pressing the power switch 58 thereto the "OFF" position; removing the power cord 60 therefrom the power source; pulling the inflatable bladder 20 out of the pool 40; drying off and folding the inflatable bladder 20; and, placing the inflatable bladder 20 and the air pump assembly 50 in a suitable storage area.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A winterizing system for placement thereon a swimming pool comprises:

an inflatable bladder body, comprising a plurality of air chambers separated by a plurality of dividing inner walls;

an attachment means for attaching said bladder body thereto a support structure; and, an inflating means in fluid communication therewith said plurality of air chambers;

wherein said inflatable bladder body comprises an outer diameter conforming to said swimming pool;

wherein a pool cover is placed over said inflatable bladder body;

wherein said inflatable bladder prevents rainwater, snow, ice or other debris from collecting thereon said pool cover;

wherein said inflatable bladder provides an improved retention of water therein said swimming pool;

wherein said inflating means provides a selectable means therefor an inflation or a deflation thereto said plurality of air chambers;

wherein said inflatable bladder body once inflated further comprises a dome-shaped structure further comprising a cylindrical outer wall;

a planar floor portion sealed thereto a bottom periphery thereof said outer wall with a lower seam;

a dome portion sealed thereto an upper periphery thereof said outer wall with an upper seam; and, said plurality of dividing inner walls each sealed thereto opposing inner surfaces thereof said outer wall, said floor portion, and said dome portion with an inner seam, thereby defining said plurality of air chambers therewithin;

wherein said plurality of inner walls provide a shaping means to maintain a dome-shape thereof said inflatable bladder body; and, wherein said plurality of inner walls provide an isolation means in an event of a leak or puncture thereof an individual air chamber;

wherein each of said dividing inner walls has axially opposed ends connected to said opposing inner surfaces of said outer wall; and, wherein each of said dividing inner walls has a linear bottom-most edge directly attached to said floor portion and further has a linear top-most edge directly attached to said dome portion.

2. The system of claim 1, wherein said plurality of inner walls are arranged in a parallel configuration.

3. The system of claim 1, wherein said plurality of air chambers each further comprise:

an air valve located thereon an outer surface thereof said dome portion; and, an air valve seal cap removably attached thereto said air valve, said air valve seal cap is tethered thereto an outer surface thereof said air valve;

wherein said air valve provides a corresponding size to receive said inflating means.

4. The system of claim 1, wherein said attachment means further comprises:

a plurality of tie-down loops equidistantly spaced thereabout said upper seam and each comprising a semi-circular sewn-in appendage thereof said upper seam;

a plurality of tie-downs each comprising a hooking means at a first end removably attachable thereto an individual tie-down loop and an anchoring means at a second end thereto secure said system thereto said support structure;

wherein said attachment means provide extra positional stability thereto said system.

5. The system of claim 4, wherein said plurality of tie-down loops each further comprise a corrosion-resistant crimped eyelet.

6. The system of claim 4, wherein said anchoring means further comprises an anchoring stake driven therethrough said second end.

7. The system of claim 1, wherein said inflatable bladder body further comprises a durable water-proof material.

8. The system of claim 1, wherein said inflating means further comprises:

an air compressor, comprising an air inlet nozzle and an air outlet nozzle;

an air hose in fluid communication therewith and removably attached thereto said air compressor at a proximal end;

a bladder fill nozzle attached thereto and in fluid communication therewith a distal end thereof said air hose;

a power supply cord in electrical communication therewith a power source; and, a power switch in electrical communication therewith said air compressor, providing a selectable switching means to supply power therefrom said power source thereto said air compressor;

wherein said inflation occurs when said proximal end thereof said air hose is attached thereto said air outlet nozzle;

wherein said deflation occurs when said proximal end thereof said air hose is attached thereto said air inlet nozzle.

9. A winterizing system for placement thereon a swimming pool comprises:

an inflatable bladder body, once inflated further comprising:

a cylindrical outer wall;

a planar floor portion sealed thereto a bottom periphery thereof said outer wall with a lower seam;

a dome portion sealed thereto an upper periphery thereof said outer wall with an upper seam;

a plurality of dividing inner walls each sealed thereto opposing inner surfaces thereof said outer wall, said floor portion, and said dome portion with an inner seam, thereby defining a plurality of air chambers therewithin; and, a plurality of tie-down loops equidistantly spaced thereabout said upper seam and each comprising a semicircular sewn-in appendage thereof said upper seam;

a plurality of tie-downs each comprising a hooking means at a first end removably attachable thereto an individual tie-down loop and an anchoring means at a second end thereto secure said system thereto a support structure; and, an inflating means, further comprising:

an air compressor, comprising an air inlet nozzle and an air outlet nozzle;

an air hose in fluid communication therewith and removably attached thereto said air compressor at a proximal end;

a bladder fill nozzle attached thereto and in fluid communication therewith a distal end thereof said air hose;

a power supply cord in electrical communication therewith a power source; and, a power switch in electrical communication therewith said air compressor, providing a selectable switching means to supply power therefrom said power source thereto said air compressor;

wherein said inflatable bladder body comprises an outer diameter conforming to said swimming pool;

wherein said plurality of inner walls provide a shaping means thereto said inflatable bladder body and an isolation means in an event of a leak or puncture thereof an individual air chamber;

wherein a pool cover is placed over said inflatable bladder body;

wherein said inflatable bladder prevents rainwater, snow, ice or other debris from collecting thereon said pool cover;

wherein said inflatable bladder provides an improved retention of water therein said swimming pool;

wherein said inflating means provides a selectable means therefor an inflation or a deflation thereto said plurality of air chambers;

wherein each of said dividing inner walls has axially opposed ends connected to said opposing inner surfaces of said outer wall; and, wherein each of said dividing inner walls has a linear bottom-most edge directly attached to said floor portion and further has a linear top-most edge directly attached to said dome portion.

10. The system of claim 9, wherein said plurality of inner walls are arranged in a parallel configuration.

11. The system of claim 10, wherein said plurality of air chambers each further comprise:

an air valve located thereon an outer surface thereof said dome portion; and, an air valve seal cap removably attached thereto said air valve, said air valve seal cap is tethered thereto an outer surface thereof said air valve;

wherein said air valve provides a corresponding size to receive said inflating means.

12. The system of claim 11, wherein said plurality of tie-down loops each further comprise a corrosion-resistant crimped eyelet.

13. The system of claim 11, wherein said anchoring means further comprises an anchoring stake driven therethrough said second end.

14. The system of claim 11, wherein said inflatable bladder body further comprises a durable water-proof material.

15. A method of installing a winterizing system for a swimming pool with a dome-shaped inflatable bladder comprising the following steps:

providing said inflatable bladder, once inflated further comprising:

a cylindrical outer wall;

a planar floor portion sealed thereto a bottom periphery thereof said outer wall with a lower seam;

a dome portion sealed thereto an upper periphery thereof said outer wall with an upper seam;

a plurality of dividing inner walls each sealed thereto opposing inner surfaces thereof said outer wall, said floor portion, and said dome portion with an inner seam, thereby defining a plurality of air chambers therewithin;

said plurality of air chambers each further comprising:

an air valve located thereon an outer surface thereof said dome portion; and, an air valve seal cap removably attached thereto said air valve, said air valve seal cap is tethered thereto an outer surface thereof said air valve; and, a plurality of tie-down loops equidistantly spaced thereabout said upper seam and each comprising a semicircular sewn-in appendage thereof said upper seam and a corrosion-resistant eyelet;

draining a volume of water therefrom said swimming pool to provide room for said inflatable bladder to rest thereupon a water surface and to correctly position in a vertical position;

placing said inflatable bladder thereupon said water surface such that said each air valve thereof said plurality of air chambers is positioned slightly above a wall thereof said swimming pool;

attaching a hooking means thereof a plurality of tie-downs thereto an eyelet thereof an individual tie-down loop;

anchoring said plurality of tie-downs thereto a support structure therewith an anchoring means; and, selectively choosing an inflation process or a deflation process thereto said inflatable bladder;

wherein each of said dividing inner walls has axially opposed ends connected to said opposing inner surfaces of said outer wall; and, wherein each of said dividing inner walls has a linear bottom-most edge directly attached to said floor portion and further has a linear top-most edge directly attached to said dome portion.

16. The method of claim 15, wherein said inflation process further comprises the steps of:

providing an inflating means, further comprising:

an air compressor, comprising an air inlet nozzle and an air outlet nozzle;

an air hose in fluid communication therewith and removably attached thereto said air compressor at a proximal end;

a bladder fill nozzle attached thereto and in fluid communication therewith a distal end thereof said air hose;

a power supply cord in electrical communication therewith a power source; and, a power switch in electrical communication therewith said air compressor, providing a selectable switching means to supply power therefrom said power source thereto said air compressor;

connecting said power supply cord thereto said power source;

opening an individual air valve thereto an individual air chamber by removing said air valve seal cap therefrom said air valve;

attaching said bladder fill nozzle thereto said distal end thereof said air hose;

inserting said bladder fill nozzle thereinto said air valve until obtaining a secure fit;

inserting said air outlet nozzle thereof said air compressor thereinto said proximal end thereof said air hose;

switching said power switch thereto an "ON" position to activate said air compressor, wherein said air compressor produces compressed air that travels therethrough said air hose therein to said individual air chamber;

allowing a period of time to inflate said individual air chamber;

switching said power switch thereto an "OFF" position to deactivate said air compressor when said individual air chamber is sufficiently pressurized;

removing said bladder fill nozzle therefrom said individual air valve;

replacing said air valve seal cap thereon said individual air valve;

repeating said inflation process thereto remaining air chambers until said inflatable bladder is sufficiently inflated;

removing said power supply cord therefrom said power source;

repositioning, tensioning, and adjusting said inflatable bladder;

placing a pool cover thereover said inflatable bladder and securing thereto said pool; and, storing said inflating means in a suitable storage area until subsequent use.

17. The method of claim 15, wherein said deflation process further comprises the steps of:

providing an inflating means, further comprising:

an air compressor, comprising an air inlet nozzle and an air outlet nozzle;

an air hose in fluid communication therewith and removably attached thereto said air compressor at a proximal end;

a bladder fill nozzle attached thereto and in fluid communication therewith a distal end thereof said air hose;

a power supply cord in electrical communication therewith a power source; and, a power switch in electrical communication therewith said air compressor, providing a selectable switching means to supply power therefrom said power source thereto said air compressor;

removing a pool cover therefrom said pool and said inflatable bladder;

opening one (1) or more air valve seal caps to start releasing air within one (1) or more air chambers;

connecting said power supply cord thereto said power source;

attaching said bladder fill nozzle thereto said distal end thereof said air hose;

inserting said bladder fill nozzle thereinto an individual air valve thereof an individual air chamber until obtaining a secure fit;

inserting said air inlet nozzle thereof said air compressor thereinto said proximal end thereof said air hose;

switching said power switch thereto an "ON" position to activate said air compressor, wherein said air compressor evacuates said air therefrom said individual air chamber therethrough said air hose and therethrough said air compressor;

allowing a period of time to evacuate said individual air chamber;

switching said power switch thereto an "OFF" position to deactivate said air compressor when said individual air chamber is sufficiently evacuated;

removing said bladder fill nozzle therefrom said individual air valve;

replacing said air valve seal cap thereon said individual air valve;

repeating said deflation process thereto remaining air chambers until said inflatable bladder is sufficiently evacuated;

removing said power supply cord therefrom said power source;

removing said inflatable bladder therefrom said swimming pool;

drying off and folding said inflatable bladder; and, placing said inflatable bladder and said inflating means in a suitable storage area until subsequent use.

* * * * *